US008256508B2

(12) United States Patent
Bolding et al.

(10) Patent No.: US 8,256,508 B2
(45) **Date of Patent: *Sep. 4, 2012**

(54) DOWNHOLE SAFETY VALVE APPARATUS AND METHOD

(75) Inventors: Jeffrey L. Bolding, Kilgore, TX (US); David R. Smith, Kilgore, TX (US)

(73) Assignee: Baker Hughes Incorporated, Houston, TX (US)

( * ) Notice: Subject to any disclaimer, the term of this patent is extended or adjusted under 35 U.S.C. 154(b) by 5 days.

This patent is subject to a terminal disclaimer.

(21) Appl. No.: 12/976,850

(22) Filed: Dec. 22, 2010

(65) Prior Publication Data

US 2011/0147000 A1 Jun. 23, 2011

Related U.S. Application Data

(63) Continuation of application No. 11/663,312, filed as application No. PCT/US2005/033515 on Sep. 20, 2005, now Pat. No. 7,913,769.

(60) Provisional application No. 60/522,360, filed on Sep. 20, 2004.

(51) Int. Cl.
*E21B 34/06* (2006.01)
*E21B 33/12* (2006.01)

(52) U.S. Cl. ..... 166/129; 166/133; 166/188; 166/322

(58) Field of Classification Search ..... 166/386, 166/129, 133, 188, 322
See application file for complete search history.

(56) References Cited

U.S. PATENT DOCUMENTS

| | | | | |
|---|---|---|---|---|
| 3,327,781 | A | 6/1967 | Nutter | |
| 4,022,273 | A | 5/1977 | Marathe | |
| 4,641,707 | A | 2/1987 | Akkerman | |
| 5,058,672 | A | 10/1991 | Cochran | |
| 5,125,457 | A | 6/1992 | Meaders | |
| 6,167,965 | B1 | 1/2001 | Bearden et al. | |
| 7,913,769 | B2 * | 3/2011 | Bolding et al. | 166/386 |
| 2004/0045722 | A1 | 3/2004 | Sangla | |

OTHER PUBLICATIONS

PCT International Search Report and Written Opinion corresponding to PCT/US2005/033515, dated Sep. 7, 2006.
Final Office Action corresponding to U.S. Appl. No. 11/663,312, dated Aug. 2, 2010.
Office Action corresponding to U.S. Appl. No. 11/663,312, dated Mar. 16, 2010.

* cited by examiner

*Primary Examiner* — Hoang Dang
(74) *Attorney, Agent, or Firm* — Parsons Behle & Latimer

(57) ABSTRACT

The application discloses a safety valve including a flapper valve and a packer assembly to be installed in a bore to isolate a first zone from a second zone. Preferably, the safety valve includes a hydraulic conduit bypassing the flapper valve to allow communication therethrough when the valve is closed. Furthermore, the safety valve preferably allows unobstructed passage of tools and fluids therethrough when the flapper valve is open. The application discloses a method to install a safety valve in an existing string of tubing by deploying a packer assembly having an integral safety valve.

19 Claims, 1 Drawing Sheet

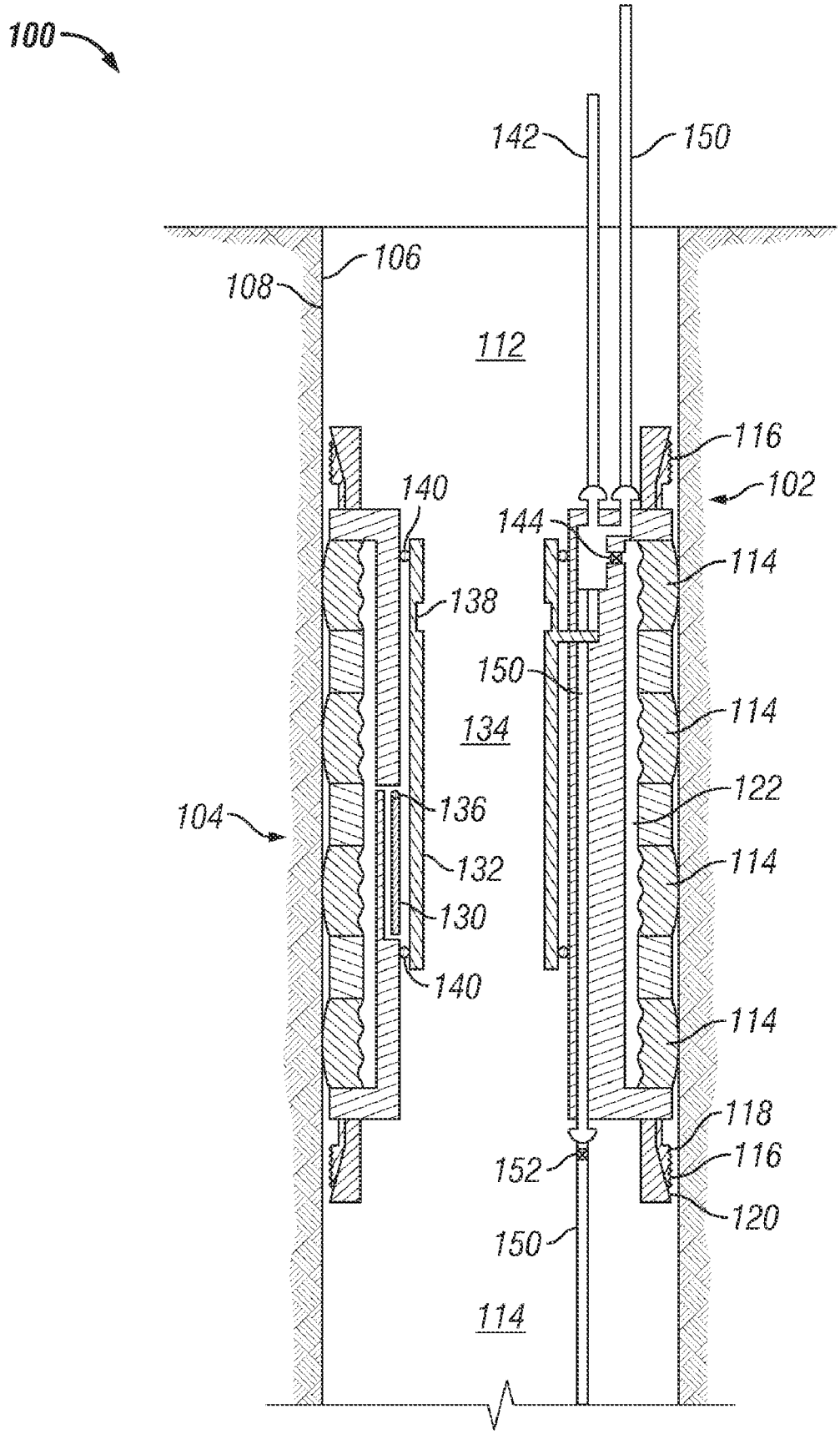
100
142
150
106
108
112
116
102
140
144
114
138
150
114
134
122
104
136
132
114
130
140
114
118
152
116
120
150
114

DOWNHOLE SAFETY VALVE APPARATUS AND METHOD

CROSS REFERENCE TO RELATED APPLICATIONS

This application is a continuation of U.S. patent application Ser. No. 11/663,312 filed on Sep. 26, 2007 now U.S. Pat. No. 7,913,769 entitled "Downhole Safety Valve Apparatus and Method," which is the National Stage of PCT/US05/33515, filed on Sep. 20, 2005, which claims benefit of U.S. Provisional Patent Application Ser. No. 60/522,360, filed on Sep. 20, 2004. The above Applications are hereby incorporated by reference in their entirety.

CROSS REFERENCE TO RELATED APPLICATION

This application claims the benefit of provisional application U.S. Ser. No. 60/522,360 filed Sep. 20, 2004.

BACKGROUND OF THE INVENTION

The present invention generally relates to subsurface safety valves. More particularly, the present invention relates to a packer with an integral subsurface safety valve to be deployed to a subsurface location. More particularly still, the present invention relates to a packer having a conduit configured to bypass an integral safety valve housed therein.

Subsurface safety valves are typically installed in strings of tubing deployed to subterranean wellbores to prevent the escape of fluids, from one downhole zone to another. These zones can be production zones, investigation zones, intermediate zones, or upper zones in communication with the surface. Subsurface safety valves are most often used to prevent the escape of fluids from production zones to the surface, but can also be used to prevent fluids from escaping from one production zone to a second production zone. Absent safety valves, sudden increases in downhole pressure can lead to catastrophic blowouts of production and other fluids into the atmosphere. For this reason, drilling and production regulations throughout the world require safety valves be in place within strings of production tubing before certain operations can be performed.

One popular type of safety valve is known as a flapper valve. Flapper valves typically include a closure member generally in the form of a circular or curved disc that engages a corresponding valve seat to isolate one or more zones in the subsurface well. The flapper disc is preferably constructed such that the flow through the flapper valve seat is as unrestricted as possible. Usually, flapper-type safety valves are located within the production tubing and isolate one or more production zones from the atmosphere or upper portions of the wellbore or production tubing. Optimally, flapper valves function as large clearance check valves, in that they allow substantially unrestricted flow therethrough when opened and completely seal off flow in one direction when closed. Particularly, production tubing safety valves prevent fluids from production zones from flowing up the production tubing when the safety valve is closed but still allow for the flow of fluids (and movement of tools) into the production zone from above.

Flapper valve disks are often energized with a biasing member (spring, hydraulic cylinder, etc.) such that in a condition with zero flow and with no actuating force applied, the valve remains closed. In this closed position, any build-up of pressure from the production zone below will thrust the flapper disc against the valve seat and act to strengthen any seal therebetween. During use, flapper valves are opened by various methods to allow the free flow and travel of production fluids and tools therethrough. Flapper valves may be kept open through hydraulic, electrical, or mechanical energy during the production process. One popular form of mechanical device to counteract the closing force of the biasing member and any production flow therethrough involves the use of a tubular mandrel. A mandrel typically has an outer profile approximate to a clearance profile of the valve seat and is forced through the clearance profile to abut and retain the flapper disc in an opened position. With the mandrel engaged within the flapper valve seat profile, the flapper valve is retained in an open position and no accidental or unwanted closure of the flapper valve occurs.

When production is to be halted or paused, the mandrel is retrieved through the valve profile and the flapper valve is once again able to close through the assistance of the biasing member or increases in pressure within the production zone. Furthermore, the mandrel is preferably equipped with its own biasing member configured to retract it from the flapper valve seat in the event of a loss of power in the actuating means. An example of a flapper-type safety valve can be seen in U.S. Pat. No. 6,302,210 entitled "Safety Valve Utilizing an Isolation Valve and Method of Using the Same," issued on Oct. 16, 2001 to Crow, et al., hereby incorporated by reference herein.

While the advantages of flapper-type safety valves are numerous, several drawbacks associated with their installation and use are also present. First and foremost, safety valves are typically installed as integral components of the production tubing assembly. As a result, an operation to install a safety valve to an existing string of production tubing typically requires the removal of the production tubing, the installation of a safety valve, and the re-installation of the production tubing. Such operations would need to be performed in circumstances where a downhole safety valve has never been installed (older production systems), where a safety valve needs to be replaced (repaired), or where additional safety valves, presumably to isolate additional production zones, are needed. Previously, apparatuses and methods to install a safety valve to or in existing tubing strings or wellbores accomplished the task at the expense of obstructing the passage of fluids and tools therethrough. A method and apparatus to install a subsurface safety valve having an unobstructed through bore to or in an existing string of tubing without necessitating the removal of that string of tubing is highly desirable.

Another disadvantage of existing safety valve systems is that after the flapper disc is closed, communication between the surface and the zone below is severed. Often, it is desirable to inject various fluids and substances into the isolated zone while leaving the flapper valve in a closed position. A safety valve assembly capable of allowing communication with the production zone when the valve is closed would be desirable to operators. Furthermore, when the flapper valve is open, any conduits deployed to a zone of interest therethrough obstruct the functioning of the safety valve. A safety valve capable of allowing communication with a production zone while the valve is in either open or closed position would be desirable to operators.

Finally, another disadvantage of existing safety valve systems is that the flappers often operate solely from the stored energy in the biasing member contained therein and from the pressure of the production zone below. No apparatus for manually closing the safety valve in the absence of one of these closing mechanisms exists. A safety valve manually closeable from the surface would likewise be highly desirable to those in the oilfield industry.

SUMMARY OF THE INVENTION

The deficiencies of the prior art are addressed by a safety valve retained in a bore between a first zone and a second zone. The bore can be a string of production tubing, casing, or an uncased borehole. The safety valve preferably includes an anchor assembly adaptable to retain the safety valve in the bore, and a flapper pivotably operable between an open and a closed position wherein the flapper hydraulically isolates the second zone from the first zone when in a closed position. The second zone can be a production zone. The first zone can be in communication with a surface location. The first zone can be a second production zone. In another embodiment of the invention, the anchor assembly comprises a packer element configured to sealingly engage the bore. In a further embodiment, an anchor assembly can include slips to retain the safety valve in the bore. The slips can be engaged by inclined planes. The slips can be engaged hydraulically, mechanically, electrically, or with a stored energy device. The slips can include a ratchet profile adaptable to maintain the slips in an engaged position.

The safety valve also preferably includes a mandrel having an unobstructed clearance passage wherein the mandrel is configured to slidably engage the flapper into the open position when actuated. Optionally, the safety valve can include a bypass conduit configured to permit communication between the first and the second zone when the flapper is open or closed. The bypass conduit can be a hydraulic tube. The bypass conduit can comprise a check valve on the bypass conduit to prevent fluidic communication from the second zone to the first zone. The check valve can be located anywhere on the bypass conduit. For example, the check valve can be located at the distal end of the conduit in the well bore; or, alternatively, the check valve can be located at or immediately below the safety valve body or fashioned in the body of the safety valve, all without departing from the spirit of the present invention. The bypass conduit can include an electrical cable or an optical fiber. The bypass conduit can comprise one or more communication ports through the safety valve. The ability to pass tools past the safety valve is highly desirable. The cross-sectional area of the clearance passage can be greater than 25% of the cross-sectional area of the bore. It is generally desirable that the cross-sectional area of the clearance passage can be greater than 50% of the cross-sectional area of the bore The deficiencies of the prior art are also addressed by a downhole packer configured to isolate a first zone from a second zone. Preferably, the packer includes an anchor assembly and a safety valve pivotably operable between an open position and a closed position wherein the safety valve blocks fluid communication from the second zone to the first zone when closed. The anchor assembly can include a set of slips to retain the downhole packer in the bore. The packer can be hydraulically or mechanically activated. The packer element can comprise an elastomeric material. The packer element can provide an abrasion shield. Furthermore, the packer preferably includes a mandrel having an unobstructed clearance passage wherein the mandrel is configured to slidably engage the safety valve into the open position when actuated. Furthermore, the packer preferably includes a bypass conduit configured to permit communication from the first zone to the second zone when the safety valve is closed.

The deficiencies of the prior art are also addressed by a well control apparatus to be installed in production casing wherein the well control apparatus includes a lubricator configured to insert a safety valve through a wellhead and a safety valve configured to be set within the production casing in a well at a prescribed depth. The well control apparatus also preferably includes a fluidic control line connected through the wellhead to provide pressure to the safety valve, wherein the fluidic control line is configured to set an anchor device and operate the safety valve from a closed position to an open position. Furthermore, the well control apparatus preferably includes at least one conduit extending from the wellhead through the safety valve and configured to communicate with the well below the prescribed depth when the valve is in a closed position.

The deficiencies of the prior art are also addressed by a method to install a safety valve in an existing string of tubing including deploying a packer assembly containing the safety valve to a prescribed depth of the string of tubing. The method also preferably includes setting a set of anchor slips, engaging a packer element, and opening the safety valve hydraulically with a mandrel of the safety packer assembly. The mandrel preferably has an unobstructed clearance passage to allow fluid and tool passage therethrough. The method preferably includes communicating with a region below the packer assembly when the safety valve is in a closed position through a fluidic line extending through the packer assembly. The method can include communicating with the region when the safety valve is in an open and a closed position.

BRIEF DESCRIPTION OF THE DRAWINGS

FIG. 1 is a schematic representation of a safety valve assembly in accordance with a preferred embodiment of the present invention.

DETAILED DESCRIPTION OF THE PREFERRED EMBODIMENTS

Referring to FIG. 1, an embodiment for a safety packer 100 is shown. Safety packer 100 includes an anchor subassembly 102 and a safety valve subassembly 104 disposed within an Inner bore 106 of a length of tubing 108 to selectively isolate a first zone 110 from a second zone 112. While safety packer 100 is expected to be used primarily within strings of production tubing, it should be understood by one of ordinary skill in the art that safety packer assembly 100 may be used with open wellbores, casing, coiled tubing, or any other application where a packer having an integral safety valve is desirable.

Anchor subassembly 102 preferably includes a packer element 114 and at least one set of anchor slips 116 to hold safety packer 100 in place within bore 106. Safety packer 100 is configured to be placed and actuated by any means known to one skilled in the art. In one mode, anchor slips 116 having biting surfaces 118 which are engaged into bore 106 by inclined planes 120 such that safety packer 100 is rigidly fixed within tubing 108 at a desired location. Anchor slips can be set through any method known to one of skill in the art, including mechanical actuation, hydraulic actuation, or electrical actuation. For example, slips 116 can be set by displacing inclined planes 120 with hydraulic cylinders, ball screws, or electrical solenoids. Additionally, slips 116 can be set by axially loading safety packer 100 or by releasing potential energy from an energy storage device (i.e. spring) by rupturing a shear pin or activating an electrical solenoid.

With anchor slips 116 set in place, packer element 114 is energized to form a hydraulic seal between safety packer 100 and inner bore 106 of tubing 108. Packer element 114 can be energized through any of several means known to one skilled in the art, but is typically energized through a fluidic means. Typically, with safety packer 100 positioned in the intended location, a fluidic line connected to packer element 114 is pressurized to expand packer element 114. Packer element preferably includes an elastomeric material of sufficient durometer to make it capable of expanding from a collapsed state to an energized and expanded state in contact with the inner diameter of bore 106 when sufficient hydraulic pressure is applied. This expansion is driven by the entry of pressurized fluid into the reservoir 122 behind packer element 114, thereby compressing element 114 into the bore 106 of tubing 108. Alternatively, packer element 114 may be energized by axially compressing packer element 114 such that the "squeezed" elastomeric material sealingly engages inner bore 106. Furthermore, a protective shielding can be applied to the outer surfaces of packing element 114 to resist abrasion or premature wear of packing element 114 in contact with tubing bore 106. Finally, depending on the particular configuration of anchor subassembly 120, packer element 114 can be set prior to setting anchor slips 116 or vice versa.

Referring still to FIG. 1, the function of the safety packer can be described. Safety packer 100 is configured to deliver a safety valve subassembly 104 to a subsurface location where either a pre-existing safety valve has failed or where no safety valve exists. As described above, safety packer 100 includes an anchor subassembly 102 and a safety valve subassembly 104. Safety valve subassembly 104 preferably includes a flapper disc 130, a tubular mandrel 132, and a clearance passage 134. Flapper disc 130 is configured to pivot about a hinge axis 136 to rotate approximately 90° from an open (as shown in FIG. 1) position to a closed position. A biasing member (not shown), preferably a torsional spring device located about hinge axis 136), typically acts upon flapper disc 130 to bias the disc in the closed position when not in use. Mandrel 132 can act to thrust and retain flapper disc in the open position when communication through clearance passage 134 is desired.

Furthermore, mandrel 132 preferably includes an exercise profile 138 and elastomeric seals (shown schematically) 140 to foster axial engagement and disengagement with flapper disc 130 in opening and closing safety valve subassembly 104. Exercise profile 138 is preferably constructed as an industry standard profile allowing for the engagement of various tools and assemblies therewith. Exercise profile 138 enables manual retrieval and disengagement of mandrel 132 if necessary. Furthermore, additional tools and equipment can be configured to engage with safety valve subassembly 104 at exercise profile 138 to perform various tasks or operations.

The operation of safety valve subassembly is preferably performed hydraulically through functional tube 142 but any other means including, but not limited to, electrical, hydraulic, pneumatic, or mechanical actuation, can be employed. Functional tube 142 can be designed to engage and set anchor subassembly 102 and operate safety valve subassembly 104 with both subassemblies in simultaneous communication with functional tube 142. Through this arrangement, increases in hydraulic pressure to functional tube 142 can expand packer element 114, set anchor slips 116, and engage mandrel 132 through flapper valve 104 subassembly simultaneously. A check valve 144 located in a hydraulic passage between the functional tube 142 and reservoir 122 behind packing element 114 is preferable to ensure that any pressure necessary to maintain packer element 114 in an engaged state remains. The check valve can be either a spring loaded valve or a ball and socket check valve. Likewise, ratchet profiles (not shown) on inclined planes 120 of anchor slips 116 can be used to maintain engagement of biting surfaces 118 within the inner bore 106 of tubing 108 after the pressure to engage slips 116 is reduced. As a result, once safety packer 100 is positioned within tube 108, an application of hydraulic pressure to functional tube 142 can inflate packing element 114, set slips 116, and operate flapper valve disc 130 with mandrel 132.

Preferably, mandrel 132 is biased against engagement with flapper disc 132 by a spring or other biasing device (not shown) so that loss of pressure in functional tube 142 will result in automatic retraction of mandrel 142 and closure of flapper disc 130. Through the use of check valve 144 and ratchet profiles as described above, reduction of hydraulic pressure in functional tube 142 results only in the closure of safety valve subassembly 104 and not in the release of anchor subassembly 102 holding safety packer 100 in place within tubing 108. This arrangement provides a fail-safe design that allows safety valve subassembly 104 to isolate zone 114 from zone 112 in the event of a total loss of electrical or hydraulic power at the surface.

To accommodate situations where it is desirable to introduce fluids to a zone below a safety valve, a bypass conduit 150 is preferably included. In one embodiment, the bypass conduit 150 preferably begins at a surface location, engages safety packer 100 at zone 112, extends through safety packer 100, and continues below safety packer 100 through zone 114. Bypass conduit 150 allows for the injection of stimulation, cleaning, dilution, and other fluids to isolated zone 114 and below when safety valve subassembly 104 is closed. A check valve 152 is preferably installed below safety packer 100 to prevent any sudden increases in pressure below packer 100 from "blowing out" through bypass conduit. Particularly, bypass conduit 150 allows for the injection of fluids into production zones under circumstances where it is undesirable to open safety valve 104.

In use, safety packer 100 operates to provide a safety valve 104 having a clear, unobstructed through passage 134 to a downhole location. This can be where no safety valve previously existed or where another valve is desired. Unobstructed passage 134, allows the passage of various tools, fluids, conduits, and wirelines from upper zone 112 to lower zone 114 with only minimal restrictions to passage. Optimally, clearance passage 134 is configured to be as close in cross-sectional area to inner bore 106 as possible. Cross-sectional clearances for passage 134 greater than 25% and 50% of bore 106 cross-sectional area are highly desirable. Absent an unobstructed passage 134, fluids flowing across safety packer 100 might experience a large pressure drop across packer 100 and reduce the flow efficiency therethrough. Former solutions to install safety valves within existing strings of tubing or wellbores restrict or prevent the passage of downhole tools Important for the continued exploration and production of a reservoir below.

Furthermore, through bypass conduit 150, a flowpath for the injection of fluids below a sealed safety valve is provided, enabling the performance of various operations (including stimulation, dilution, cleaning, etc.) at times when opening the safety valve is impractical or undesired. The bypass conduit can also contain electrical cable or an optical fiber (not shown).

Finally, in the event of a failure of a biasing member, tube mandrel 132 can be manually retracted from the surface by landing a retracting device in exercise profile 138 of tube mandrel 132. Once so engaged, the retracting device can be manually raised to retrieve tube mandrel 132 from safety valve subassembly 104, thereby assisting in closing flapper valve 130. The mandrel can be retracted by wireline, solid member, etc. Although used in a safety packer for illustrative purposes, the safety valve containing a mandrel with an unobstructed clearance passage can be used in any bore without a packer. Similarly, the safety valve with a bypass conduit can be used in any bore and is not limited to use in only safety packers.

What is claimed:

1. A safety valve retained in a bore between a first zone and a second zone, the safety valve comprising:

an anchor assembly adaptable to retain the safety valve in the bore;

a flapper pivotably operable between an open position and a closed position, the flapper hydraulically isolating the second zone from the first zone when in the closed position;

a mandrel having an unobstructed clearance passage, the mandrel configured to slidably engage the flapper in the open position when actuated, the mandrel biased against engagement with the flapper; and a bypass conduit extending through the safety valve and configured to permit communication between the first zone and the second zone when the flapper is in the closed position, wherein the second zone is below the flapper and the bypass conduit permits the injection of fluids to the second zone when the flapper is in the closed position.

2. The safety valve of claim 1 further comprising a hydraulic tube in communication with the anchor assembly and the mandrel.

3. The safety valve of claim 2 wherein an application of hydraulic pressure to the hydraulic tube engages one or more anchor slips of the anchor assembly against an inner surface of the bore.

4. The safety valve of claim 2 wherein an application of hydraulic pressure to the hydraulic tube causes the mandrel to slidably engage the flapper in the open position.

5. The safety valve of claim 2 wherein the hydraulic tube is in communication with a packer element configured to sealingly engage the bore.

6. The safety valve of claim 2 wherein a loss of hydraulic pressure from the hydraulic tube causes retraction of the mandrel and closure of the flapper.

7. The safety valve of claim 1 wherein the bypass conduit comprises at least one optical fiber.

8. The safety valve of claim 1 wherein the bypass conduit comprises at least one electrical cable.

9. The safety valve of claim 1, the mandrel comprising an exercise profile that permits manual retraction of the mandrel.

10. An apparatus comprising:

a flapper pivotably operable between an open position and a closed position, the flapper configured to hydraulically isolate a first zone from a second zone when in the closed position;

an anchor assembly adaptable to retain the flapper in a bore;

a mandrel having an unobstructed clearance passage, the mandrel configured to slidably engage the flapper in the open position when actuated;

a bypass conduit configured to permit communication between the first zone and the second zone when the flapper is in the closed position; and a hydraulic tube in communication with the anchor assembly and the mandrel.

11. The apparatus of claim 10 wherein the mandrel is biased against engagement with the flapper.

12. The apparatus of claim 10 wherein an application of hydraulic pressure to the hydraulic tube engages one or more anchor slips of the anchor assembly against an inner surface of the bore.

13. The apparatus of claim 10 wherein an application of hydraulic pressure to the hydraulic tube causes the mandrel to slidably engage the flapper in the open position.

14. The apparatus of claim 10 wherein the hydraulic tube is in communication with a packer element configured to sealingly engage the bore.

15. The apparatus of claim 10 wherein a loss of hydraulic pressure from the hydraulic tube causes retraction of the mandrel and closure of the flapper.

16. The apparatus of claim 10 wherein the bypass conduit comprises at least one optical fiber.

17. The apparatus of claim 10 wherein:

a. the second zone is below the flapper; and b. the bypass conduit permits the injection of fluids to the second zone when the flapper is in the closed position.

18. The apparatus of claim 10, the mandrel comprising an exercise profile that permits manual retraction of the mandrel.

19. A safety valve retained in a bore between a first zone and a second zone, the safety valve comprising:

an anchor assembly adaptable to retain the safety valve in the bore;

a flapper pivotally operable between an open position and a closed position;

said flapper hydraulically isolating the second zone from the first zone when in said closed position;

a mandrel having an unobstructed clearance passage;

said mandrel configured to slidably engage said flapper into said open position when actuated;

a hydraulic tube in communication with the anchor assembly and the mandrel; and a bypass conduit extending through the safety valve and configured to permit communication between the first zone and the second zone when said flapper is in said closed position, wherein the bypass conduit includes an optical fiber.

* * * * *